US010077178B2

(12) United States Patent
Benz

(10) Patent No.: US 10,077,178 B2
(45) Date of Patent: Sep. 18, 2018

(54) LIFTING APPARATUS FOR LIFTING AND LOWERING VEHICLES

(71) Applicant: Gerhard Finkbeiner, Freudenstadt (DE)

(72) Inventor: Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 6 days.

(21) Appl. No.: 14/899,200

(22) PCT Filed: May 26, 2014

(86) PCT No.: PCT/EP2014/060808
§ 371 (c)(1),
(2) Date: Dec. 17, 2015

(87) PCT Pub. No.: WO2014/206668
PCT Pub. Date: Dec. 31, 2014

(65) Prior Publication Data

US 2016/0137470 A1 May 19, 2016

(30) Foreign Application Priority Data

Jun. 27, 2013 (DE) ..... 20 2013 102 803 U

(51) Int. Cl.
*B66F 3/00* (2006.01)
*B66F 13/00* (2006.01)
(Continued)

(52) U.S. Cl.
CPC ..... *B66F 13/00* (2013.01); *B66F 3/02* (2013.01); *B66F 3/46* (2013.01); *B66F 7/025* (2013.01); *B66F 7/04* (2013.01); *B66F 7/28* (2013.01)

(58) Field of Classification Search
CPC ..... B66F 13/00; B66F 13/02; B66F 13/46; B66F 7/28; B66F 7/04; B66F 7/025
See application file for complete search history.

(56) References Cited

U.S. PATENT DOCUMENTS 4,212,449 A * 7/1980 Tsujimura ..... B66F 7/04 187/213
4,679,660 A * 7/1987 Suzuki ..... B66F 7/28 187/219
(Continued)

FOREIGN PATENT DOCUMENTS

CN 102387980 A 3/2012
DE 76 19 866 U 11/1976
(Continued)

OTHER PUBLICATIONS

International Search Report for corresponding patent application No. PCT/EP2014/060808 dated Jul. 7, 2014.

*Primary Examiner* — David Bryant
*Assistant Examiner* — Nirvana Deonauth
(74) *Attorney, Agent, or Firm* — Renner, Otto, Boisselle & Sklar, LLP

(57) ABSTRACT

The invention relates to a lifting apparatus for lifting and lowering vehicles, loads or the like, with a support (17) which is movable up and down and on which support (17) a load receiving means (18) is provided, wherein the load receiving means (18) has at least one supporting arm (21) which is mounted on the support (17) so as to be pivotable about a pivot axis (22), and with a locking device (37), which locking device (37) fixes the supporting arm (21) in an adjusted position with respect to the support (17), wherein the locking device (37) is released in the lowered state of the support (17) and, when the support (17) is raised, is locked and secures the adjusted pivoted position of the supporting arm (21) with respect to the support (17),
(Continued)

Figure 1:
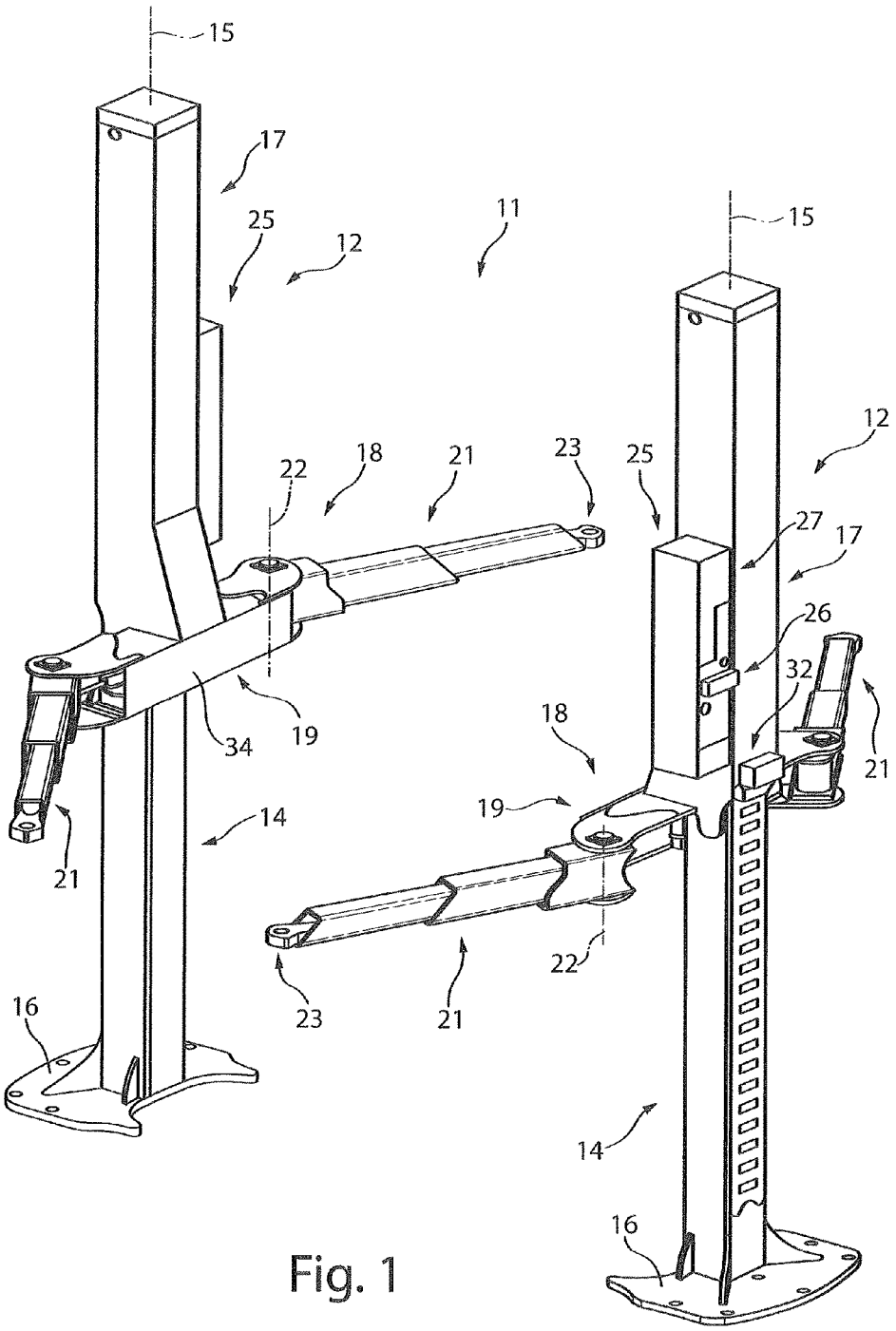

wherein the locking device (37) comprises at least one actuable adjusting device (38) which is effective for the positioning of the supporting arm (21) in a pivoted position with respect to the support (17) and is automatically transferable into a locking position and fixes the adjusted pivoted position of the support (17).

16 Claims, 7 Drawing Sheets

(51) Int. Cl.

| | |
|---|---|
| ***B66F 7/02*** | (2006.01) |
| ***B66F 7/04*** | (2006.01) |
| ***B66F 7/28*** | (2006.01) |
| ***B66F 3/46*** | (2006.01) |
| ***B66F 3/02*** | (2006.01) |

(56) References Cited

U.S. PATENT DOCUMENTS

| | | | | | |
|---|---|---|---|---|---|
| 4,715,477 | A * | 12/1987 | Suzuki | B66F 7/02 | 187/210 |
| 4,749,169 | A * | 6/1988 | Pickles | B66F 3/12 | 254/122 |
| 4,825,977 | A * | 5/1989 | Isogai | B66F 7/02 | 187/203 |
| 4,976,336 | A * | 12/1990 | Curran | B66F 7/04 | 187/208 |
| 6,279,685 | B1 * | 8/2001 | Kogan | B66F 7/28 | 187/203 |
| 6,634,461 | B1 * | 10/2003 | Baker | B66F 3/46 | 187/210 |
| 2010/0051884 | A1 * | 3/2010 | Matthews | B66F 7/28 | 254/45 |
| 2012/0032126 | A1 | 2/2012 | Finkbeiner | | |
| 2012/0048653 | A1 * | 3/2012 | Matthews | B66F 7/08 | 187/211 |
| 2015/0298947 | A1 * | 10/2015 | Davis | B66F 3/24 | 254/89 H |

FOREIGN PATENT DOCUMENTS

| | | | |
|---|---|---|---|
| DE | 27 42 518 | A1 | 3/1979 |
| DE | 691 07 560 | T2 | 6/1995 |
| EP | 0478035 | A1 | 4/1992 |
| FR | 2 302 272 | A1 | 9/1976 |
| FR | 2 356 343 | | 1/1978 |
| JP | S62 211299 | A | 9/1987 |
| JP | S63 56190 | U | 4/1988 |
| JP | S63 56191 | U | 4/1988 |
| JP | 2005 320173 | A | 11/2005 |
| JP | 4358793 | B2 | 11/2005 |

* cited by examiner

LIFTING APPARATUS FOR LIFTING AND LOWERING VEHICLES

The invention relates to a lifting device for lifting and lowering vehicles, loads or similar, in particular a two-column lifting platform having pivotable support arms.

A two-column lifting platform is known from DE 691 07 560 T2 which consists of two lifting columns and supports which are able to move up and down on the lifting columns. Two jointed arms are provided on each support as pivotable support arms which are pivotable and able to be positioned with the load receiving element thereof underneath a vehicle to be lifted with respect to the load receiving points located there. To secure the adjusted position of the support arms with respect to the support, a locking device is provided which is unlocked in the case of a lowered support, such that the support arms are freely pivotable. Directly after the beginning of a lifting movement of the support, the adjusted positions of the support arms with respect to the support are fixed by the locking device, such that the adjusted support arm position with regard to the vehicle is maintained. This locking device comprises a truncated cone-shaped gearwheel on which a truncated cone-shaped sprocket, formed in a complementary manner, is able to be set. A vertical traversing movement between the truncated cone-shaped gearwheel and the sprocket is therefore required for the decoupling and subsequent locking. Furthermore, the respective support arm can only be arranged at predetermined intervals with regard to its pivot position due to the toothing. In the case of long support arms, the intervals cause the load receiving elements to lie far from each other at locked pivot points, such that an exact positioning of the load receiving elements of the support arms at the receiving points of the respective vehicle is difficult. The same is known from FR 75 06246 A1.

A two-column lifting platform is known from U.S. Pat. No. 4,679,660, which consists of two lifting columns, on each of which a support is able to move up and down. Each support receives two pivotable support arms. These support arms are controllable with regard to the angular position thereof with respect to one another by means of lifting cylinders. Furthermore, in the lowered state of the support, an automatic retraction of the support arms with regard to the extended length is controllable.

A locking device for a pivot arm of a lifting platform emerges from DE 27 42 518 A1, which directly strikes a piston rod of a piston which is fastened between the support and the pivot arm. This locking device is exclusively able to be operated manually.

Furthermore, a two-column lifting device is known from U.S. Pat. No. 4,715,477, which comprises two pivot arms on a support. A locking device is provided on the support which is released in the lowered state of the support in order to trigger a pivot movement of the pivot arm. During lifting of the support, a locking of the locking device then occurs if the pivot arm is positioned in a predetermined position with regard to a locking rod of the locking device, so that a latch element arranged on a hollow cylinder of the locking device engages with a latch mechanism on a cylinder rod which is guided in the hollow cylinder.

The object of the invention is to create a lifting device for lifting and lowering vehicles, loads or similar which enables a simple and quick releasing and locking of the locking position of the support arms with respect to the support in any pivot position within the pivot region of the support arm.

This object is solved according to the invention by a lifting device in which the locking device comprises at least one positioning device which acts to position a support arm with respect to the support in a pivot position and is autonomously transferable into a locking position, and fixes the adjusted pivot position of the support. This locking device has the advantage that a direct adjustment of the pivot angle of the support arm with respect to the support is enabled. In particular, such a positioning device can fix an adjusted pivot position of the support arm, which is preferably infinitely adjustable, within the pivot region of the support arm.

A preferred embodiment of the invention provides that the positioning device is formed as a hydraulic, pneumatic, electric or electromagnetically driven positioning device or as a linear drive. Using such positioning devices, the pivot movements of the support arms relative to the support can be actively initiated, controlled and preferably held fixedly in an end position. Additionally, this advantageous embodiment of the locking device has the advantage that the pivot arm is able to be locked without clearance with regard to the support.

An alternative embodiment of the invention provides that the positioning device is formed as a manually operable positioning device and in particular comprises a hydraulic or pneumatic cylinder. This arrangement enables a pivot position of the support arm with respect to the support to be adjustable without supply of external energy and only by manual operation, and the hydraulic or pneumatic cylinder to be able to be held fixedly in this end position.

A preferred embodiment of the locking device provides that the positioning device is controllable with a switching valve or switching contact. The positioning device can therefore be transferred in a simple manner from an unlocked or released position into a locked or secured position. For example, to lock the locking position or secure the pivot position of the support arm, the adjusted position of the support arm with respect to the support can only be secured by a blocking of the switching valve.

A preferred embodiment of the lifting device provides that the positioning device is formed as a hydraulic or pneumatic cylinder which is formed as a double-acting cylinder having equal-sized piston surfaces in the chambers of the positioning device, which are connected to an overflow pipe. An immediate locking of the pivot position of the piston rod of the hydraulic cylinder therefore occurs directly after a traversing movement during the closing of the two piston chambers or of the overflow pipe, whereby the position of the support arm is also fixed, which is struck by a piston rod of the hydraulic cylinder. Furthermore, no additional storage is required for a fluid in the hydraulic cylinder. Additionally, such a lock has the advantage that this is wear-free over the service life of the lifting device.

One advantageous embodiment of the invention provides that the overflow line connecting the piston chambers is controllable by the switching valve. Therefore a simple construction can be provided which also comprises a small design.

The switching valve is advantageously formed at least as a two-path valve which blocks or releases at least the overflow line. Consequently, each uniquely assumed position can be secured by a switching of the switching valve.

A preferred embodiment of the lifting device provides that the piston rod of the positioning device strikes the support arm at a distance from the pivot axis of the support arm with respect to the support. Favourable lever ratios can thereby be created in order to receive the required torque which can act on a maximum support arm length.

The locking device is preferably provided to be pivotable on the support, wherein a housing of the positioning device is arranged to be pivotable on a bearing surface of the support. The pivot axis of the housing which is received to be pivotable is thus aligned in parallel to the rotational axis of the support arm. A compensation movement of the positioning device therefore occurs at a distance from the rotational axis of the support arm due to the strike point of the piston rod.

The housing of the positioning device preferably has a bearing journal for the formation of the bearing surface, said bearing journal being mounted rotatably in a bore of a bearing plate of the bearing surface. This represents a constructively simple arrangement and receiving of the positioning device on the support.

Preferably, furthermore, the switching valve can be integrated in the bearing surface. Here, an operating device or longitudinal axis of the switching valve is preferably arranged concentrically to the pivot axis of the bearing journal.

The pivot movement of the support arm can be manually controllable. In a manual embodiment, the user will push the support arm into the desired pivot position with his hand or with his foot. Alternatively, the positioning device can be controlled with a hydraulic pump or an electric drive. In this instance, both a separate drive unit and the drive device of the lifting device can be used, which can be provided for lifting and lowering the support.

Furthermore, the switching valve is preferably mechanically switchable using a push button element. Therefore, a simple mechanical release can be created, with which the locking device is automatically unlocked in a lowered position of the support and an automatic locking of the locking device occurs directly after the lifting, or better after a minimum lifting of the support from the lowered position. Alternatively, a switching valve or switching contact can be electrically controllable. Advantageously, a wireless control of the switching valve or switching contact is thereby controllable, for example by means of remote control.

The lifting device has an at least partially closed housing section having a housing base, preferably on the support, in which housing base the locking device is provided, wherein this housing base has a perforation in which the push button element of the switching valve or switching contact is arranged. A protected arrangement of the locking device can therefore be provided, wherein nevertheless an automatic release during lifting of the support to the locking positioning is enabled during lowering of the support and a blocking is enabled.

For secure operation of the push button element, the lower side of a housing base is preferably provided with a protective cover allocated to the perforation which covers the perforation and is formed as a bending tab. A protected arrangement of the push button element and of the associated switching valve or switching contact can thereby be enabled.

Preferably, the push button element opposite the outer side of the housing base protrudes downwards in a locking position of the locking device, and the protective cover, which is preferably formed as a bending tab, is lifted relative to the outer side of the housing base at least in the periphery of a switching path of the switching valve. It is thereby visible from the outside that the locking device is in a locking position. Additionally, a simple operation of the push button element can thereby be enabled as, during lowering of the support, the protective cover abuts on the base or a foot plate of the lifting column and operates the push button element, wherein the push button element itself is protected by the protective cover and remains protected. This arrangement also manually enables an operation of the locking device by the pressing of the protective cover on the outer side or lower side of the housing base in the lifted state of the support, wherein this automatically returns again to its locking position for release.

Alternatively, for example, a wire rope hoist, a wire rope or similar can strike the push button element or the protective cover, said wire rope hoist having an operating grip, an operating strap or an operating element on the opposite end such that this, for example, is manually controllable at a distance from this. For example, an end can be provided adjacent to the control panel, adjacent to an on and off switch operating element of the control of the lifting device or on the outer side of the housing.

A further preferred embodiment provides that two pivotable support arms are arranged on the support, the rotational axis of which are each provided adjacent to the lifting axis of the support. An arrangement can thereby be created, wherein, in particular in the case of a symmetrical arrangement, the rotational axes of the support arms are spaced apart at the same distance to the vertical axis of the lifting column.

Furthermore it is preferably provided that a positioning device which is controllable by a control of the lifting device comprises at least one control device which is preferably controllable wirelessly. Such an arrangement has the advantage that the operator can control one or more of such lifting devices by means of a control device preferably formed as a remote control. Alternatively or additionally, a positioning of the support arm with regard to the load receiving points on the vehicle can also occur via such a remote control. Furthermore, the support is preferably able to move up and down along a lifting column or on a lifting stamp of a stamp platform or a half- or double-scissor lifting platform. This arrangement is usable in a variety of ways and is adaptable to the respective design of the support.

Furthermore, the support arms of the load receiving element preferably have at least two support arm sections which are connected to each other to be pivotable and are positioned with respect to each other in the pivot position using at least one locking device. This embodiment of the support arm can be provided alternatively to a telescopic support arm. Here, a first support arm section which is arranged on the support, as well as at least one further support arm section, can each be adjustable in the pivot position thereof on the load receiving point on the vehicle or the load.

A further advantageous embodiment of the lifting device provides two or more lifting columns which are allocated to each other in pairs, for the formation of a two-column lifting platform or a multi-column lifting platform. These lifting platforms are advantageously each formed to be self-sufficient such that the control lines or static components connecting the lifting devices which stand opposite one another are dispensable.

Figure 2:
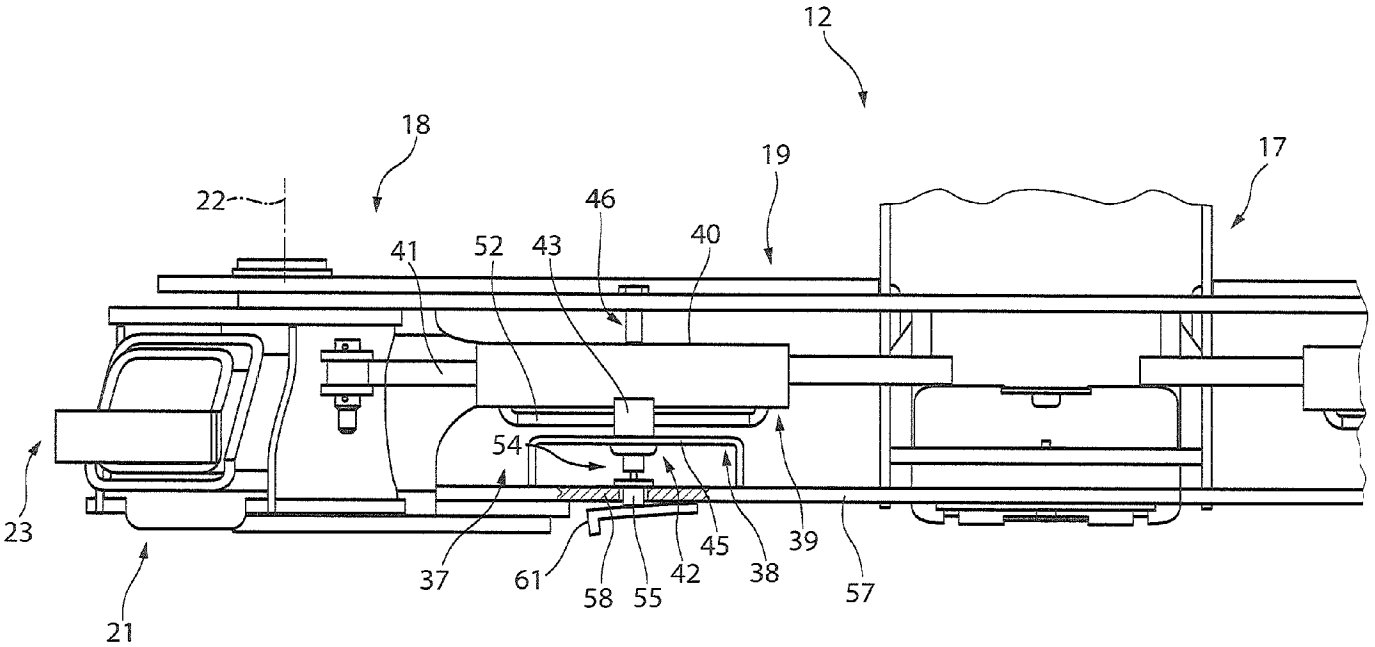
Figure 3:
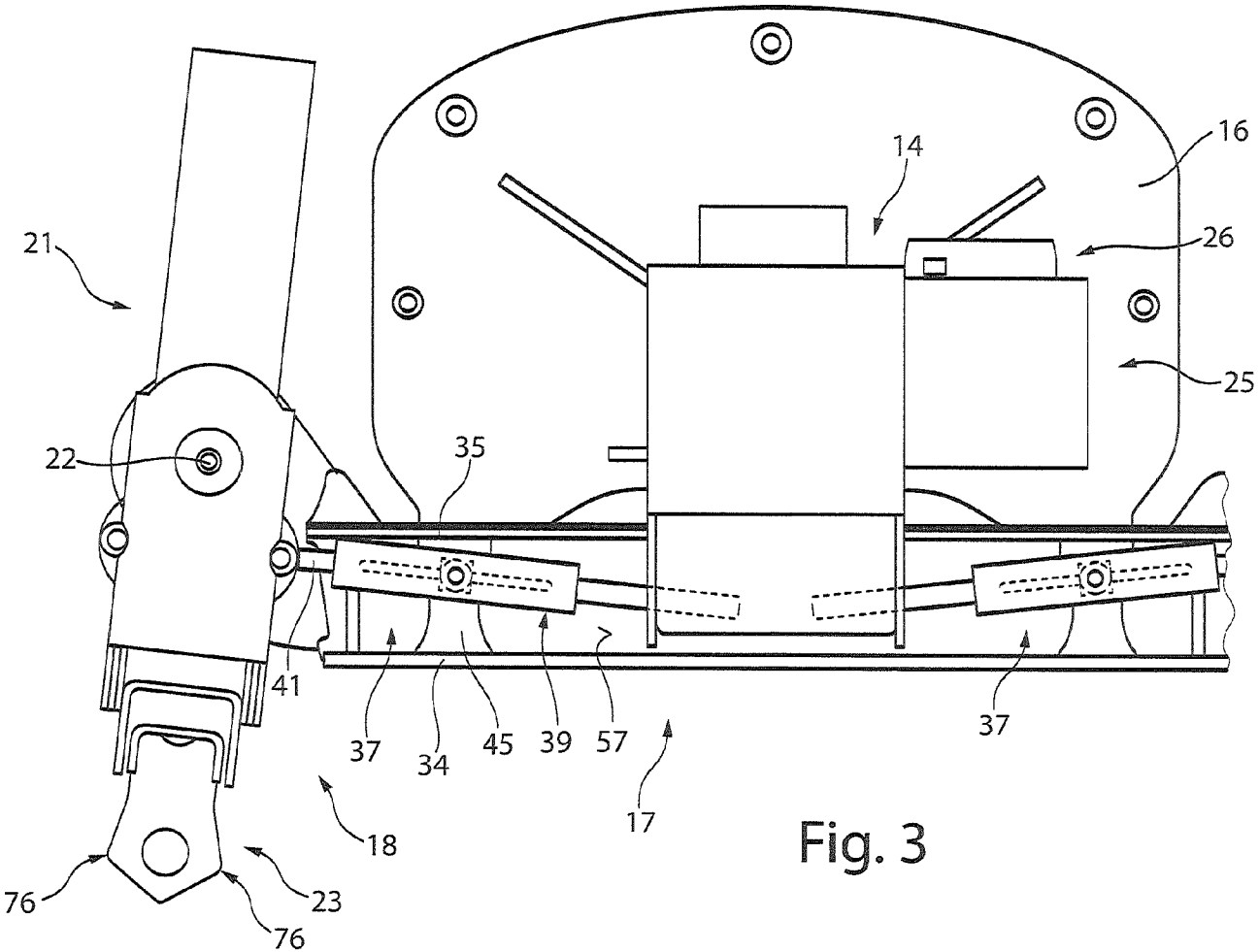
Figure 4:
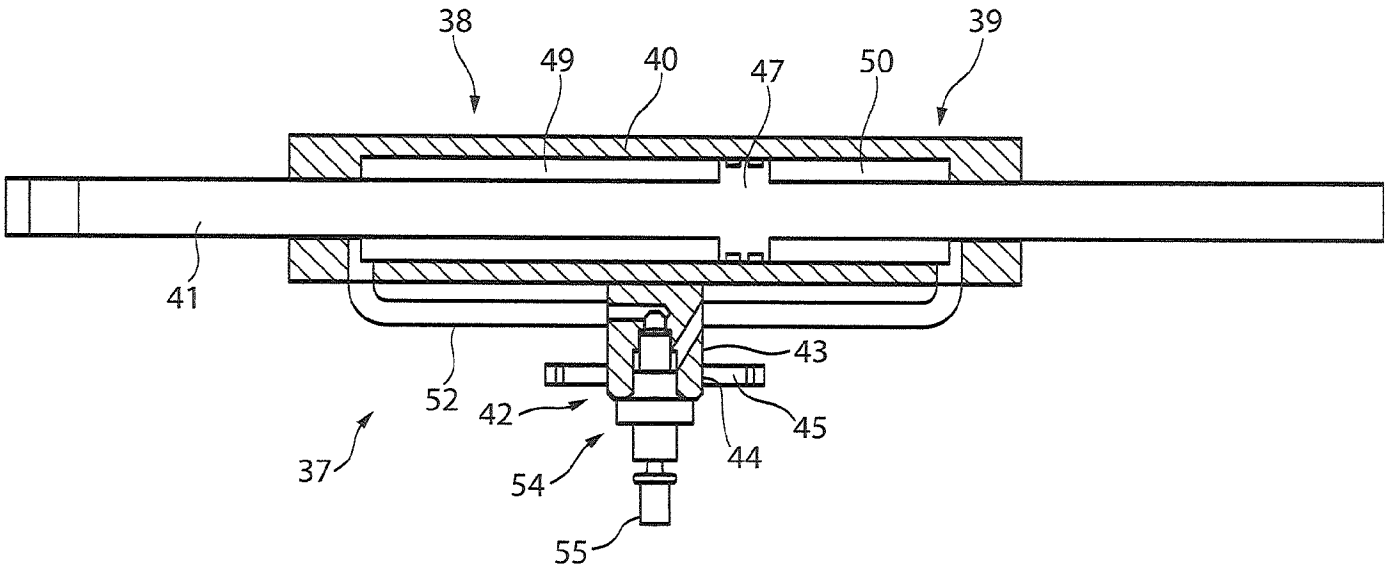
Figure 5:
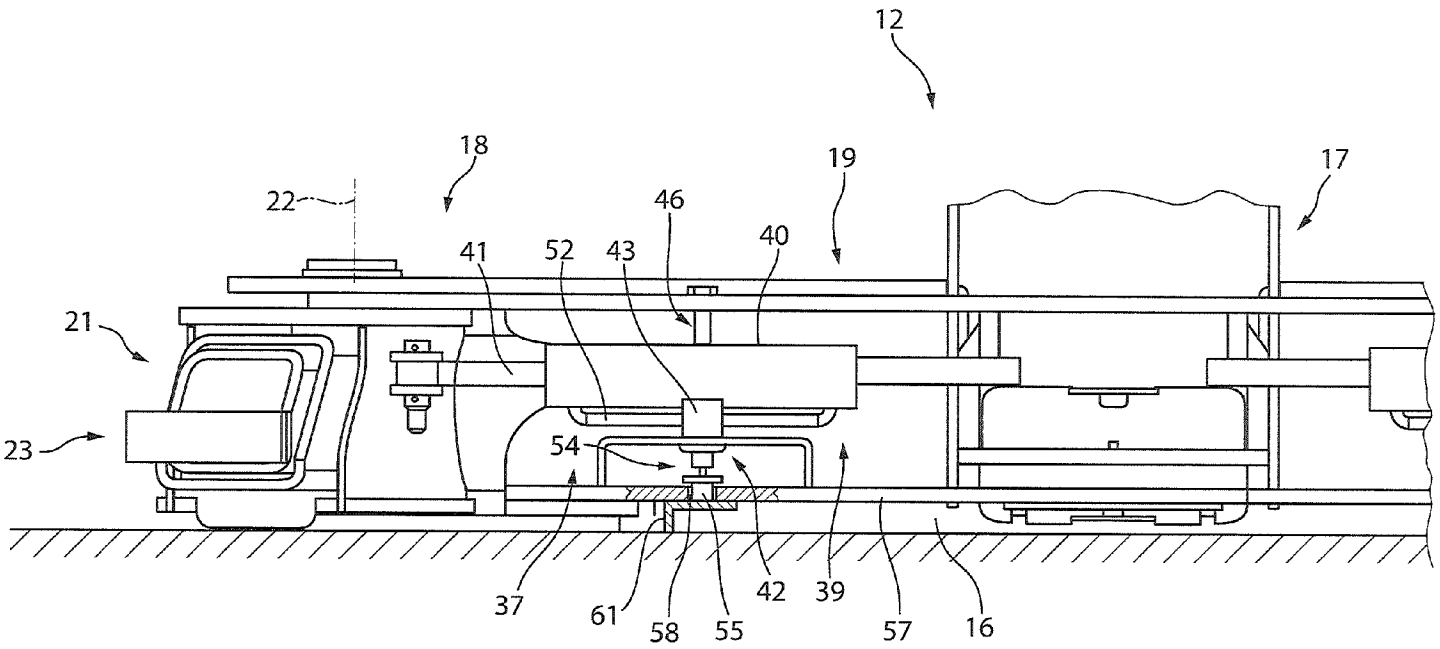
Figure 6:
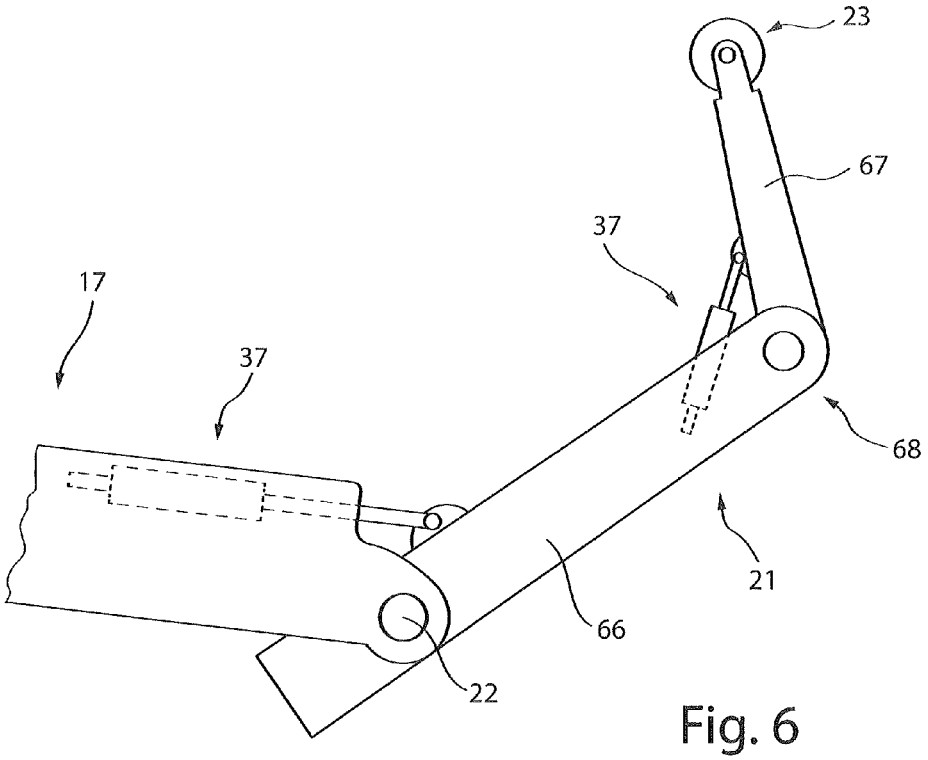
Figure 7:
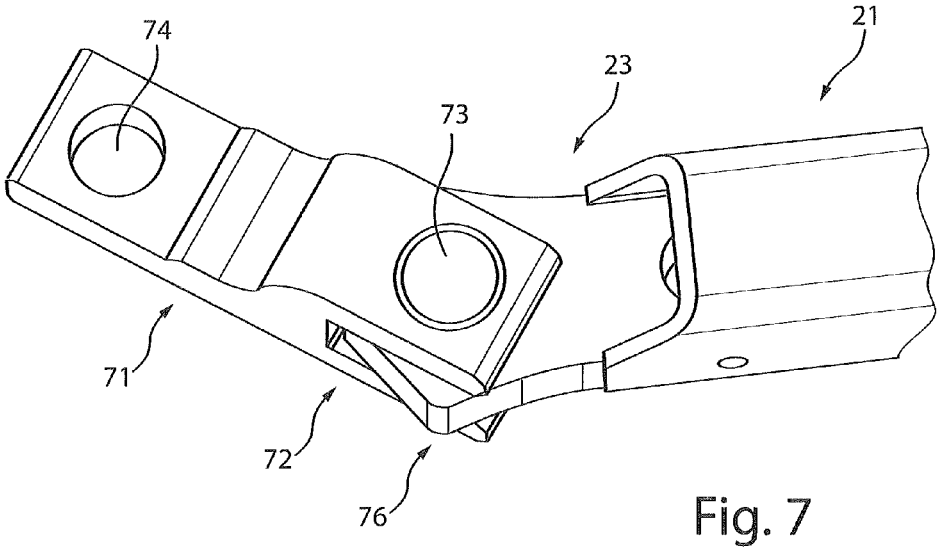
Figure 8:
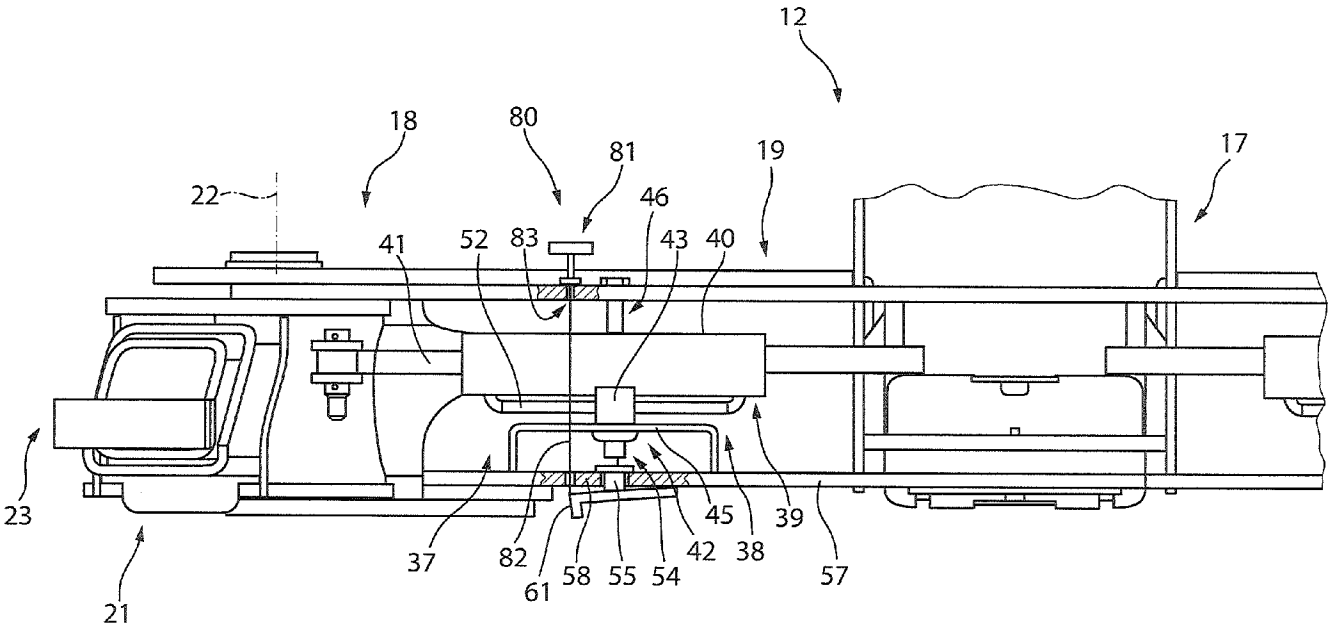

The invention as well as further advantageous embodiments and developments of the same are described and explained in more detail below by means of the examples depicted in the drawings. The features to be gleaned from the description and the drawings can be applied individually or together in any combination according to the invention. Here are shown:

FIG. 1 a perspective view of a lifting device forming a two-column lifting platform, FIG. 2 a schematic side view of the support arm and of the support of the lifting device having a locking device in a locked position, FIG. 3 a schematic view from above onto the support arm and support having the locking device according to FIG. 2, FIG. 4 a schematic side view of the locking device in the sectional cut, FIG. 5 a schematic side view of the support arm having a locking device in an unlocked position, FIG. 6 a schematic view from above of an alternative embodiment of a support arm of the load receiving element, FIG. 7 a perspective view of an elongation on a support arm, and FIG. 8 a schematic view of the support arm and of the support of the lifting device having a locking device in a locked position according to FIG. 2 having a hand unlocking device.

In FIG. 1, for example, a two-column lifting platform 11 is depicted perspectively which comprises two lifting devices 12 which are allocated to each other. This lifting device 12 comprises a lifting column 14 which is connected firmly, for example, to a base plate 16 which is connected fixedly to the ground. A carrier 17 is provided to be able to move up and down along a lifting axis 15 of the lifting device 11. The support receives a load receiving means 18. The load receiving means 18 comprises a housing section 19 which is at least partially closed, on the respective outer ends of which support arms 21 are received to be pivotable around a vertical pivot axis 22. These support arms 21 can be formed to be telescopic and have the pivot axis 22 opposite load receiving elements 23 or provisions to arrange different load receiving elements 23 exchangeably.

The support 17 furthermore receives a drive device 25. This can be formed electro-hydraulically, hydraulically or mechanically and has a hydraulic unit according to the depicted embodiment. This drive device 25 is monitored and controlled by a control 26. At least one accumulator 27, for example, can be provided for the energy supply. The control 26 advantageously works wirelessly. In particular, a remote control can be provided in order to control the lifting devices 12. In particular, the two lifting devices 12 which are allocated to each other and lie opposite each other communicate wirelessly with each other in order to ensure, for example, a simultaneous initiation of a lifting and lowering movement as well as to ensure a mutual monitoring of synchronisation or similar. Alternatively, supply lines and/or control lines can be provided between the two lifting devices 12 such that both control signals and a current supply are enabled, connected via cable.

The support 17 is formed to be sleeve- or cartridge-shaped and encloses the lifting column 14. In this arrangement it is therefore provided that the drive spindle or the hydraulic cylinder is arranged within the lifting column 14 for lifting and lowering the support 17. The hydraulic cylinder is supported on one side on a lower end of the lifting column 14 or the base plate 16 and strikes the upper, inner end section of the support 17. To guide the support 17 to the lifting column 14, guide elements 29 lying therebetween are provided which, for example, can be formed as rolling or sliding elements or as a combination thereof. Furthermore, a drop guard 32 is provided between the lifting column 14 and the support 17, using which a deactivation or a current disconnection of a holding magnet of the drop guard occurs and a locking element implements a securing of the adjusted lifting position.

An alternative embodiment of the lifting device 12 provides that the lifting columns have a U-shaped cross-section, within which the support is guided to be able to move up and down, wherein the at least partially closed housing section 19 is arranged analogously to the lifting device 12 according to FIG. 2 on the carrier 17 in order to receive the support arms 21.

A further alternative embodiment of the lifting device 11 can be that, instead of the lifting column and the support which is able to move up and down, a lifting stamp of a stamp platform is provided, wherein the support is arranged at the upper end of the lifting stamp, at which the support arms 21 are provided.

Furthermore, a further alternative embodiment of the lifting device 11 can be provided in which the supports which are able to move up and down are moved up and down by means of a half-scissor or double-scissor mechanism which are in turn operated with a hydraulic cylinder, on which the support arms 21 can be arranged.

In FIG. 2, a view from the front onto the support 17 having an open housing section 19 is depicted in which a front cover 34 (FIG. 1) is removed from the housing section 19. In the housing section 19 of the support 17, a locking device 37 is provided which strikes the support arm 21. An adjusted pivot position of the support arm 21 can be fixed using this locking device 37, such that the adjusted pivot position of the support arm 21 with regard to a load point is maintained on a vehicle.

The locking device 37 comprises an operable positioning device 38 which is formed according to the exemplary embodiment as a hydraulic cylinder. This hydraulic cylinder 39 comprises a piston rod 41, the one outer end of which, removed from the pivot axis 22, strikes the support arm 21. The hydraulic cylinder 28 comprises a bearing journal 43 which engages with a bore 44 of a bearing plate 45, whereby a bearing surface 42 is provided for the pivotable mounting of the hydraulic cylinder 28. The hydraulic cylinder 28 is held secured with respect to the bearing surface 42 using a securing element 46. In the exemplary embodiment, this can, for example, be a socket pin, a screw or similar which fastens in an upper part of the housing section 19 and strikes a housing 40 of the hydraulic cylinder 39 and is fixed with respect to the bearing surface 42.

The positioning device 38 can comprise, alternatively to the hydraulic cylinder 39, a pneumatically driven or electrically or electromagnetically driven positioning device and/or a reciprocating piston. Alternatively, a linear drive can also be provided which in turn can be driven electrically, pneumatically or hydraulically. A positioning movement or a traversing movement of the positioning device 38 can be controlled by a switching valve 54 or a switching contact, the functionality of which is described further below. Alternatively, the positioning movement can also be drive only via a control device of the lifting device 12.

In FIG. 3, a schematic view from above onto the lifting device 12 is depicted, wherein an upper part of the housing section 19 is removed in order to depict the arrangement and positioning of the locking device 37 within the housing section 19. The bearing surface 42 is formed by the bearing plate 45 which is fastened both to the front cover 34 and to a rear cover 35. The hydraulic cylinder 39 strikes the support arm 21 with a free end of the piston rod 41, removed from the pivot axis 22. Due to the pivotable arrangement of the hydraulic cylinder 39 with respect to the bearing surface 42, the housing 40 of the hydraulic cylinder 39 can carry out a compensation movement or pivot movement relative to the bearing surface 42, whereby an unhindered pivoting of the support arm 21 is enabled within the provided pivot region.

The bearing surfaces 42 to receive the hydraulic cylinders 39 are spaced wide apart from one another in such a way that the piston rods 41 of the hydraulic cylinders 39 do not mutually impede one another.

In FIG. 4, a schematically enlarged sectional view of the locking device 37 is depicted. This comprises the at least one hydraulic cylinder 39 which is formed as a double-acting cylinder. This has a piston 47, the respective piston surface of which that points towards the chamber 49, 50 is formed to be the same size. The chamber 49 and chamber 50 are connected to each other directly by an overflow line 52, wherein a switching valve 54 is provided in the overflow line 52 which, in a switching position, releases a flow in the overflow line 52 and, in another switching position, blocks the overflow line 52. The switching valve 54 furthermore comprises a push button element 55, using which the switching valve 54 is manually controllable according to a first embodiment. Such a locking device 37 enables an automatic releasing and locking of a pivot position of the support arm 21 with respect to the support 17 during lifting and lowering of the support 17 of the lifting device 12, as is described below by means of FIGS. 2 and 5.

Alternatively, the switching valve 54 or the switching contact can also be controlled wirelessly in the case of an electrically controlled positioning device 38.

FIG. 2 shows a schematic side view of a support arm 21 having the locking device 37 in a lifted position or during a lifting or lowering phase of the support 17 with respect to the lifting column 14. FIG. 5 shows a side view of the support arm 21 and the locking device 37 in a lowered position, which means that the locking device 37 is unlocked or released.

In the depiction according to FIG. 2, the locking device 37 is located in a locked position. The switching valve 54 blocks the transfer line 52 such that a displacement movement of the piston rod 41 is not possible due to the double-acting hydraulic cylinder 39. Rather, the adjusted pivot position of the support arm 21 with respect to the support 17 is maintained. Due to the use of such a hydraulic cylinder 37, any pivot position of the support arm 21 with respect to the support 17 can be assumed and adjusted.

A perforation 58 is provided in a lower housing base 57 of the housing section 19 (FIG. 2), through which the push button element 55 protrudes at least slightly compared to an outer side of the housing base 57. A protective cover 61 can be provided to be allocated to this perforation 58, said protective cover 61 being formed, for example, to be strip-shaped as a bending tab. This protective cover 61 is lifted by the push button element 55, which is arranged in a locked position of the locking device 37, compared to the outer side of the housing base 57. During an upward movement of the support 17 into an initial position of the lifting device 12 to load and unload a vehicle or of loads, the protective cover 61 comes into contact with the base plate, whereby the push button element 55 is operated and the switching valve 54 is transferred from a locking or blocking position into an unlocking position. In this unlocking position, the overflow line 52 is not interrupted, which means that the support arm 21 is freely pivotable and the work fluid displaced in a piston chamber 49 is displaced directly into the opposite piston chamber 50 or vice versa. Preferably, an oil or another incompressible medium is provided as a work medium.

Therefore, during lowering of the support 17 having the load receiver 18, an automatic unlocking of the locking device 37 is enabled.

This automatic locking of the locking device 37 also occurs during a lifting movement of the carrier 17 with respect to the lifting column 14. After, for example, the support arms 21 are positioned with respect to the load receiving points of a vehicle or of a load and a lifting movement of the support 17 is controlled, a locking of the adjusted pivot position of the support arm(s) 21 occurs directly after the lifting of the support arm 21 from the lowered position. The lifting after which this locking occurs is adjustable, for example, via the length of the push button element 55 or the switching path of the switching valve 54.

The releasing and locking of the locking device 37 can alternatively also occur by a sensor or a proximity switch which is provided on the lifting device 12. In this instance, on the one hand, the ground base can be a reference point, on which the lifting device 12 is mounted. Alternatively, a reference point can also be provided within the lifting device 12, which means that, for example, a locking or an unlocking is controllable during a height measurement or measurement of the lifting movement.

Furthermore, alternatively, a pivot movement of the support arm 21 is controlled by a motor, by, for example, a retraction or extension movement to adjust the pivot position of the support arm 21 being controlled via a hydraulic pump of the drive device of the hydraulic cylinder 39.

In FIG. 6, an alternative embodiment of a support arm 21 to the embodiments above is depicted. This support arm 21 comprises a first support arm section 66 as well as a second support arm section 67, which are connected to each other to be pivotable via a joint connection 68. The load receiving element 23, for example, is arranged on the outer end of the support arm section 67. Alternatively, a further support arm section could be arranged on the joint or could be telescopic. The locking device 37, for example, strikes between the first and second support arm section 66, 67 in the same way as is provided between the first support arm section 66 and the support 17. Using the two locking devices 37, both support arm sections 66, 67 can therefore be aligned and controlled targetedly and flexibly relative to the support 17 in the position thereof with regard to the load receiving element 23 with respect to the load receiving points.

In FIG. 7, a further preferred embodiment of a support arm 21 having a load receiving element 23 is depicted, to which an elongation 71 of the support arm 21 is applied. The elongation 71 has a U-shaped or fork-shaped receiving section 72 which encompasses the load receiving element 23 on both sides. A pin 73 is inserted, for example from above, in a bore depicted on the load receiving element 23 (FIG. 3), whereby the extension 71 is secured to be pivotable with respect to the load receiving element 23. The extension 71 has a bore 74 lying opposite the pin 73 into which a support element, for example having a rubber support, is able to be inserted exchangeably, which is provided to position the load receiving points of a vehicle. Using the extension 71, an adaptation to different sized bodies can additionally be enabled. For secure receiving of the extension 71, for example in the angular arrangement with respect to the support arm 21 depicted in FIG. 7, the load receiving element 23 comprises support surfaces 76 which are also depicted in FIG. 3 in the top view. These support surfaces 76 form an enlarged support surface for the extension 71 in different angular positions and ensure that no rotation of the extension 71 with respect to the support arm 21 occurs in the case of an occurring load. Such extensions 71 can be different sizes, in the case of which the distance between the bore 74 and the pin 73 varies.

In FIG. 8, the locking device 37 of the support 17 of the lifting device 12 is equipped with a handling device 80 which enables a manual operation of the locking device 37 independently of the position of the load receiver 18 with regard to the lifting height, in order to change the support arm 21 in its pivot position.

This hand unlocking device 80 comprises an operating handle 81, which for example can be arranged on an upper side of the housing section 19. From this operating handle 18, a wire rope hoist 82 extends through a first bore 83 in the upper housing section and through a bore 83 in the housing base 57, such that the opposite end strikes the freely deflectable end of the protective cover 61, preferably releasably. Due to this arrangement, during lifting of the operating handle 81 relative to the housing section 19, the protective cover 61 is positioned to abut onto the lower side of the housing base 57, whereby the push button element 55 as a consequence transfers the switching valve 54 from a locking position into an unlocking position in order to subsequently pivot the support arm 21. During release of the operating handle 81, the protective cover 61 returns to the initial position depicted in FIG. 2 due to the restoring force of the switching valve 54 or due to the formation of the protective cover 61, and the adjusted pivot position of the support arm 21 is fixed.

Alternatively, the wire rope hoist 82 can also directly strike the push button element 55.

The operating handle 81 can also be positioned at another point of the lifting device 12, such as for example in the region of the drive control 25 or of the housing of the drive control 35 as well as on the support 17.

Furthermore, the locking devices 37 of the left and right support arm 21 can be unlocked at the same time by means of an operating handle 81. For this purpose, for example within the support 17, a wire rope hoist guide can be provided by means of deflection rollers.

All aforementioned features are each significant to the invention in themselves and can be combined with one another in any combination.

The invention claimed is:

1. A lifting device for lifting and lowering vehicles, loads or similar, having a support which is movable up and down, on which a load receiving means is provided, wherein the load receiving means has at least one support arm which is mounted on the support to be pivotable around a pivot axis, and having a locking device which fixes the support arm with respect to the support in an adjusted position, wherein the locking device is released in the lowered state of the support and is locked during lifting of the support and secures the adjusted pivot position of the support arm with respect to support, wherein the locking device comprises at least one hydraulic cylinder which acts to position the support arm with respect to the support in a pivot position and is infinitely adjustable, is autonomously transferable into a locking position and fixes the adjusted pivot position of the support arm, wherein the hydraulic cylinder is controllable with a switching valve, and a traversing movement of a piston rod in the hydraulic cylinder is controllable by the switching valve being arranged in an overflow line connecting opposite chambers of the cylinder that are separated by a piston to which the piston rod is connected.

2. The lifting device according to claim 1, wherein the pivot position of the support arm is infinitely variable using the hydraulic cylinder.

3. The lifting device according to claim 1, wherein the hydraulic cylinder has a double acting cylinder having two equal sized piston surfaces on the piston.

4. The lifting device according to claim 1, wherein the switching valve is formed at least as a two-way valve which releases or blocks at least the overflow line.

5. The lifting device according to claim 1, wherein the piston rod of the hydraulic cylinder strikes the support arm at a distance from the pivot axis of the support arm.

6. The lifting device according to claim 1, wherein a housing of hydraulic cylinder is arranged to be pivotable on a bearing surface of the support and the housing of the hydraulic cylinder has a bearing journal which is mounted rotatably in a bore of a bearing plate.

7. The lifting device according to claim 6, wherein an operating direction or longitudinal axis of the switching valve is arranged concentrically to a pivot axis of the bearing journal.

8. The lifting device according to claim 1, wherein the pivot movement of the support arm is controllable manually or using a drive device, preferably using a hydraulic pump or an electric drive.

9. The lifting device according to claim 1, wherein the switching valve is mechanically switchable using a push button element or is controllable using an electromagnetically controllable, or a wirelessly electromagnetically controllable switching valve.

10. The lifting device according to claim 9, wherein the locking device is provided in an at least partially closed housing section of the support, which has a housing base having a through bore in which the push button element of the switching valve is arranged.

11. The lifting device according to claim 10, wherein a protective cover is provided on an outer side of the housing base which covers a perforation of the housing base and is formed as a bending tab.

12. The lifting device according to claim 9, wherein the switching valve is mechanically switchable using a push button element, and in a locking position of the locking device, the push button element protrudes downwards compared to an outer side of a base and a protective cover which covers the push button element is lifted at least partially compared to the outer side of the base.

13. The lifting device according to claim 12, wherein the push button element or the protective cover is operable using a hand unlocking device.

14. The lifting device according to claim 1, wherein two pivotable support arms are arranged on the support, wherein pivot axes of which are each provided adjacent to a lifting axis.

15. The lifting device according to claim 1, wherein a drive device controllable by a control is provided which comprises at least one control device which is controllable by wire or wirelessly.

16. The lifting device according to claim 1, wherein the support arm has at least two support arm sections which are connected to each other to be pivotable and are positioned with respect to each other in the pivot position using at least one locking device.

* * * * *